US009793042B2

(12) United States Patent
Scholz

(10) Patent No.: US 9,793,042 B2
(45) Date of Patent: Oct. 17, 2017

(54) PRINTED CIRCUIT BOARD HAVING A LAYER STRUCTURE

(71) Applicant: PHOENIX CONTACT GMBH & CO. KG, Blomberg (DE)

(72) Inventor: Peter Scholz, Brakel (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 174 days.

(21) Appl. No.: 14/762,731

(22) PCT Filed: Jan. 20, 2014

(86) PCT No.: PCT/EP2014/050997
§ 371 (c)(1),
(2) Date: Jul. 22, 2015

(87) PCT Pub. No.: WO2014/114584
PCT Pub. Date: Jul. 31, 2014

(65) Prior Publication Data

US 2015/0357113 A1 Dec. 10, 2015

(30) Foreign Application Priority Data

Jan. 22, 2013 (DE) ..... 10 2013 100 622

(51) Int. Cl.
*H01F 5/00* (2006.01)
*H01F 27/28* (2006.01)
(Continued)

(52) U.S. Cl.
CPC ..... *H01F 27/2804* (2013.01); *H01F 5/00* (2013.01); *H01F 27/323* (2013.01);
(Continued)

(58) Field of Classification Search
CPC ..... H01F 5/00; H01F 27/00–27/30
(Continued)

(56) References Cited

U.S. PATENT DOCUMENTS 4,494,100 A * 1/1985 Stengel ..... H01F 5/003 336/200
5,015,972 A 5/1991 Cygan et al.
(Continued)

FOREIGN PATENT DOCUMENTS

DE 41 17 878 A1 12/1991
DE 43 17 545 A1 12/1993
(Continued)

OTHER PUBLICATIONS

International Search Report issued in connection with corresponding International Application No. PCT/EP2014/050997 dated Mar. 7, 2014 (12 pages total).
(Continued)

*Primary Examiner* — Tuyen Nguyen
(74) *Attorney, Agent, or Firm* — Maldjian Law Group LLC

(57) ABSTRACT

The invention relates to a printed circuit board having a layer structure, which accommodates a plurality of electric circuits. The electric circuits are separated from each other by an insulating barrier layer having a minimum thickness (Di) and a minimum distance (D0) between conductive components of the electric circuits.

19 Claims, 4 Drawing Sheets

(51) Int. Cl.
*H01F 27/32* (2006.01)
*H01F 19/08* (2006.01)

(52) U.S. Cl.
CPC ..... *H01F 2019/085* (2013.01); *H01F 2027/2809* (2013.01); *H01F 2027/2819* (2013.01)

(58) Field of Classification Search
USPC ..... 336/65, 83, 200, 232
See application file for complete search history.

(56) References Cited

U.S. PATENT DOCUMENTS 5,312,674 A * 5/1994 Haertling ..... H01L 23/055 252/62
5,420,558 A 5/1995 Ito et al.
5,583,474 A 12/1996 Mizoguchi et al.
6,175,293 B1 * 1/2001 Hasegawa ..... H01F 1/15308 336/150
7,741,943 B2 * 6/2010 Fouquet ..... H01F 27/2804 336/200
7,852,186 B2 * 12/2010 Fouquet ..... H01F 19/08 336/107
8,319,573 B2 11/2012 Kanschat et al.
2003/0095027 A1 5/2003 Shu Yuen Hui et al.
2011/0095620 A1 4/2011 Fouquet et al.

FOREIGN PATENT DOCUMENTS

DE 10 2007 034 750 3/2008
DE 10 2010 063 858 6/2011
EP 0 491 214 A1 6/1992
EP 1 310 036 B1 5/2004
GB 2 163 603 A 2/1986
JP 3-171705 7/1991

OTHER PUBLICATIONS

International Preliminary Report on Patentability dated Aug. 6, 2015 for PCT Application No. PCT/EP2014/050997.

* cited by examiner

PRINTED CIRCUIT BOARD HAVING A LAYER STRUCTURE

FIELD OF THE INVENTION

The invention relates to a printed circuit board having a layer structure, which comprises a transformer for galvanic isolation between individual electric circuits.

BACKGROUND OF THE INVENTION

US 2011/0095620 A1=DE 10 2007 034 750 A1 discloses an improved galvanic isolator with an inductive transducer in a layer structure. On the upper and lower surfaces of a substrate plate which forms a barrier layer having a sufficient thickness and sufficient insulation characteristics, conductive traces are provided to define coil windings which are protected by insulating cover layers which partially have feeding conductive traces extending thereon which, in a first embodiment, are connected to a transmitter chip or a receiver chip through vias. The vias extend through the insulating cover layers and partly through the substrate plate as well. The coil windings form the inductive transducer which, in a second embodiment, is connected to the transmitter chip and the receiver chip by wire connections. Thus, the chips with the electrical or electronic components are arranged outside the galvanic isolator.

A broadband radio-frequency transformer having a layer structure is known from U.S. Pat. No. 5,015,972, wherein primary and secondary windings are arranged between dielectric layers which in turn are located between ferrite cover plates. Electrical or electronic components are not included in the layer structure.

An energy supply unit for transmitting auxiliary energy is known from EP 1 310 036 B1 and comprises primary and secondary coils provided on carrier plates with an air gap therebetween. In order to extend the clearance distance between the coils, an insulating plate is disposed in the air gap which protrudes beyond the carrier plates. A layer structure of a printed circuit board is not formed in this manner.

In some electrical/electronic devices high voltages have to be handled, and for protecting against overvoltages a galvanic isolation is often provided between individual electric circuits or potential groups within the device. In order to avoid electrical flashovers in the devices, specific clearance and creepage distances for discharge currents must be kept between the electric circuits to be separated, or an insulating material of a predetermined quality and minimum thickness has to be placed between the electric circuits. Thus, there is a galvanic isolation distance between the individual electric circuits, across which electrical energy is to be exchanged, which is useful for power supply or data exchange or information exchange. This electrical energy will be referred to as an electrical signal below.

Printed circuit boards, also referred to as circuit boards or PCBs, are often used as a carrier for electrical/electronic components, assemblies and conductive traces (referred to as "components" below). Printed circuit boards may be flexible or rigid and are available in a layer structure design. For galvanic isolation between different electric circuits or potential groups on the printed circuit board it has been known to provide a "trench" on the printed circuit board, across which no component extends. The width of the isolation trench corresponds to the minimum distance in air or the minimum creepage distance along the surface of the isolation trench, which must be kept in order to achieve sufficient electrical voltage protection. The wider the isolation trench is selected on the printed circuit board, the less usable area is available for accommodating electrical/electronic components.

For signal exchange, galvanically isolated electric circuits are coupled with each other by coupling components, and for this purpose inductive and capacitive transformers or antenna systems operating in the electromagnetic near field are useful, each comprising a first and at least a second coupling element between which a solid insulating material extends. The dielectric strength of this insulating material determines the tolerable voltage difference between the potential groups or individual electric circuits.

SUMMARY OF THE INVENTION

The invention is based on the object to provide a printed circuit board with a galvanic isolation between individual electric circuits, in which comparatively high voltages between the individual electric circuits can be tolerated without having to accept comparatively large clearance and creepage distances for electrical discharge currents along the surface of the printed circuit board. Furthermore, the printed circuit board should preferably have a simple, low-cost and space-saving configuration for the accommodated components.

The invention is specified in the claims.

For galvanic isolation between the individual electric circuits, the printed circuit board comprises at least one inductive and/or capacitive transformer, each of which comprises a first and a second coupling element with an insulating barrier layer sandwiched therebetween. This insulating barrier layer provides as much as possible of the required isolation. As a result, isolation trenches for clearance and creepage distances on the printed circuit board may be largely omitted or their number may be considerably reduced. This is based on the fact that with respect to the same insulation values, the dimension of planar isolation regions for clearance and creepage distances is greater than the thickness of the insulating barrier layer. A planar isolation region refers to a surface region which extends on the printed circuit board and also around the edge of the printed circuit board and occupies a minimum distance between galvanically isolated electric circuits or potential groups, measured as a clearance and creepage distance for electrical flashover or leakage currents. A precise definition of clearance and creepage distances and their requirements can be found in the descriptions and figures of standards DIN EN 60664-1, DIN EN 60079-11/15, and DIN EN 61010-1, for example. Insulating parts mounted to the printed circuit board for enlarging the clearance and creepage distances or increasing the dimension of the planar isolation region are accordingly regarded as parts of the printed circuit board, even if these parts do not have a layer structure.

Furthermore, the reduction of space requirements on the printed circuit board by eliminating or minimizing isolation trenches results in a reduction of costs for manufacturing the printed circuit board. Structurally simple coupling elements based on planar technology allow further cost savings. In this case, the coupling elements are produced in form of loops of conductive traces or in form of capacitor plates, for example.

Specifically, with the insulating barrier layer the material of the printed circuit board itself is used as an insulating medium between adjacent electric circuits. The two opposite sides of the layer structure are utilized for the different electric circuits or potential groups, and the electrical/electronic components are mounted on both sides of the printed circuit board. Through-hole contacts across the printed circuit board through vias are largely avoided or only provided at a lateral distance from the transformers.

BRIEF DESCRIPTION OF THE DRAWINGS

Exemplary embodiments of the invention will now be described with reference to the drawings, wherein.

DETAILED DESCRIPTION

Figure 1:
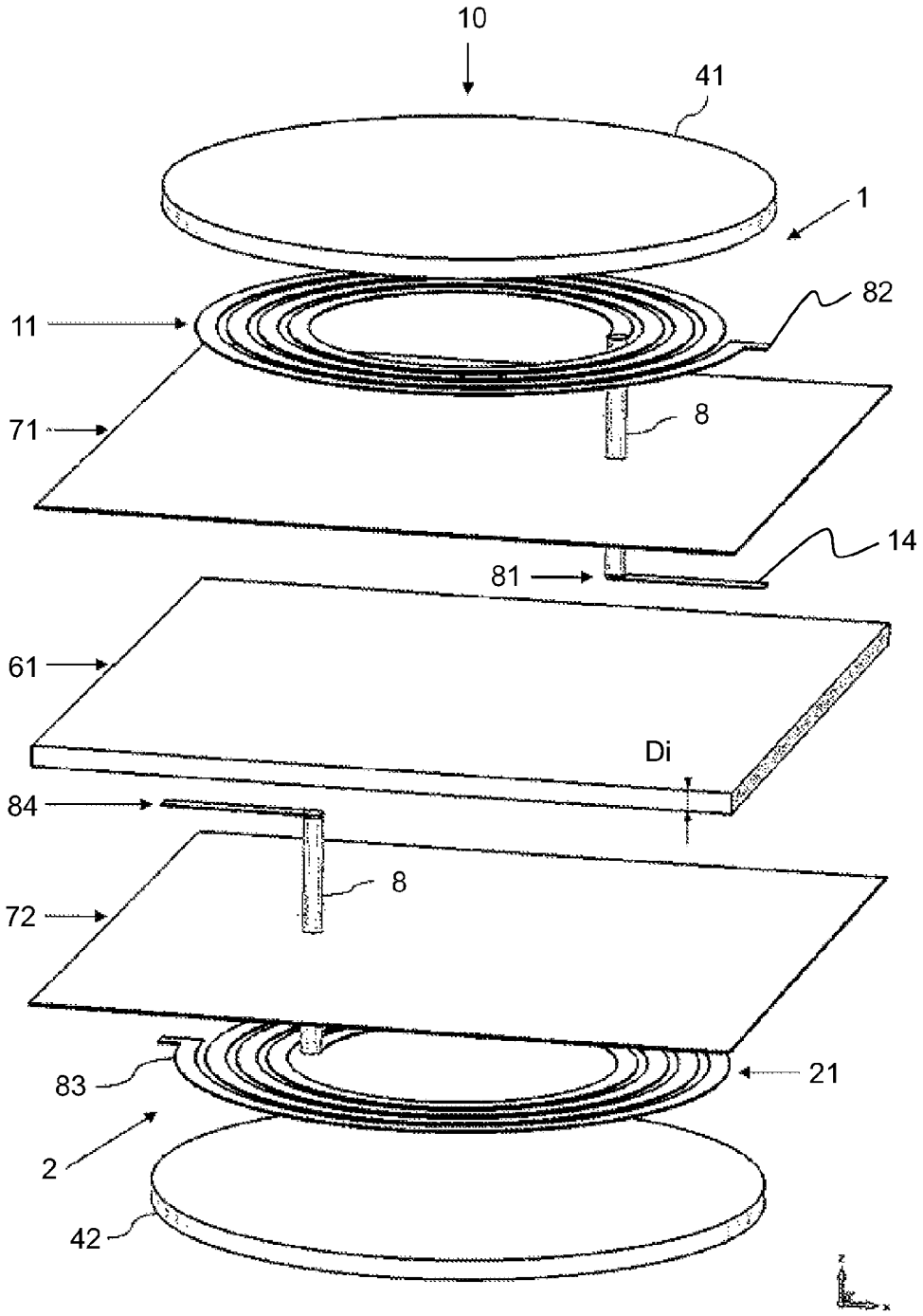
FIG. 1 shows an inductive transformer in an exploded view of the various layers as a portion of a printed circuit board.

FIG. 1 shows the layer structure of a printed circuit board according to the invention, with the individual layers of the layer structure pulled apart in Z direction. The layer structure comprises a first insulating spacer layer 71, an insulating barrier layer 61 and a second insulating spacer layer 72. First insulating spacer layer 71 provides a mounting surface for components, i.e. electrical/electronic components 13 and for conductive traces 14 (see FIG. 2). Second insulating spacer layer 72 also provides a mounting surface for components, i.e. electric/electronic components 23 and for conductive traces 24. Electrical contacts 8 extend through the respective insulating spacer layer 71 or 72 in order to connect the respective conductive traces on the upper surface to the lower surface of the respective insulating spacer layer. A helical coil 11 extends on the upper surface of insulating spacer layer 71 and has a connection end 82 that may be connected to electrical/electronic components, and has another connection end 81 that passes to the other side of insulating spacer layer 71 via electrical contact 8 to be connected to electrical/electronic components there as well. Another spiral coil 21 is disposed below insulating barrier layer 61 and has two connection ends 83 and 84 which are arranged on different sides of second insulating spacer layer 72, and the connection from the upper to the lower surface of the insulating spacer layer is again provided via an electrical contact 8. Coils 11 and 21 are separated from each other by insulating barrier layer 61 and constitute the coupling elements of an inductive transformer 10. For increasing the efficiency of inductive transformer 10 and for shielding against interference, ferrite plates 41 and 42 may be provided in spatially overlapping relationship to coils 11 and 21. In order to avoid short circuiting of coil windings by electrically conductive bodies, an additional insulating layer (not shown) is provided between the ferrite elements and the coil windings, for example in the form of a suitable coating.

Figure 2:
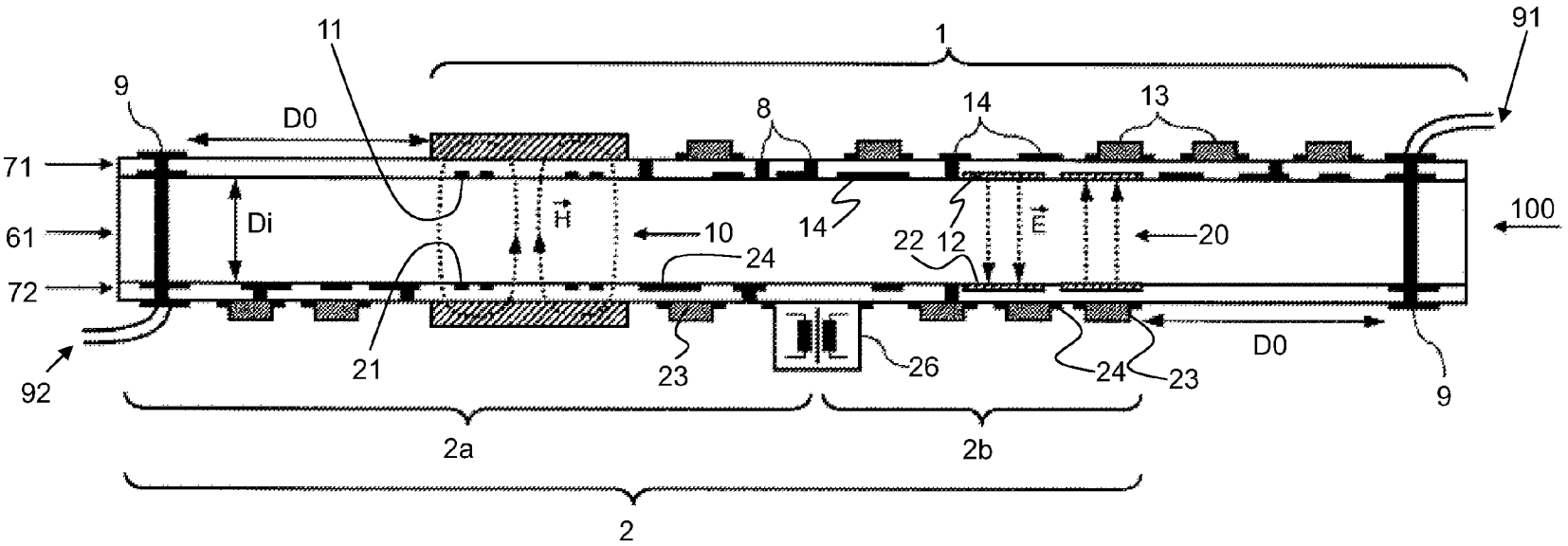
FIG. 2 is a longitudinal sectional view through a printed circuit board with components mounted on both sides thereof.

FIG. 2 shows a printed circuit board 100. The inductive transformer 10 defined by coils 11, 21 has an overlapping and transfer region which is the major propagation region of the alternating magnetic fields, as illustrated at H in FIG. 2. Transformer 10 can be used to exchange energy between a first electric circuit 1 and a second electric circuit 2. This exchanged energy will be referred to as a signal in the present application and can be exploited for data exchange in well-known manner. In the illustrated exemplary embodiment, first electric circuit 1 and second electric circuit 2 are additionally coupled with each other via a capacitive transformer 20 which comprises capacitor plates 12, 22 in an overlapping and transfer region and allows signal transmission between the first and second electric circuits via alternating electric fields E.

First electric circuit 1 comprises electrical/electronic components 13 which are mounted on the free upper surface of insulating spacer layer 71 and supplied with voltage/current via conductive traces 14. Conductive traces 14 extend on both sides of insulating spacer layer 71 and are connected via contacts 8, as illustrated. Second electric circuit 2 is arranged on the upper and lower surfaces of second insulating spacer layer 72 and comprises electrical/electronic components 23 and conductive traces 24 in a similar manner as described above for electric circuit 1 with respect to components 13 and conductive traces 14. The exemplary embodiment of FIG. 2 additionally comprises an inductive transformer 26 which divides electric circuit 2 into two sections 2*a* and 2*b*. This is to illustrate the diverse options for mounting on and division of the printed circuit board.

For integrating printed circuit board 100 into a device, electrical connection lines 91, 92 are required for power supply and signal handling purposes. Such lines may be mounted to an insulating spacer layer 71 or 72. Furthermore, anchors in form of electrical vias 9 that extend through the layer structure of printed circuit board 100 may be provided for mounting such lines 91, 92. Such electrical vias weaken the dielectric strength of the layer structure and in particular that of insulating barrier layer 61 in a certain range which has to be considered as a minimum distance D0 to "external" or "adjacent" electric circuits. Though connection lines 91 for power and signal supply to electric circuit 1 may of course be arranged directly adjacent to elements 11, 12, 13, 14 of electric circuit 1, the minimum distance D0 which is the clearance and creepage distance to electric circuit 2 must be kept between electrical via 9 and the closest component of electric circuit 2. Similarly, the electrical via 9 which is connected to connection lines 92 must keep the minimum distance D0 to the closest components of electric circuit 1. For protecting against flashovers between the electric circuits, it is furthermore necessary to observe a minimum thickness Di of the insulating barrier layer between the electric circuits. This minimum thickness Di depends on the quality of the insulating material and the level of overvoltage that is to be tolerated. For example, if printed circuit board material FR4 is used as an insulating medium, a dielectric strength of approximately 40 kV per millimeter can be expected. Therefore, a minimum thickness of 0.2 mm would correspond to a dielectric strength of 8 kV, while a minimum thickness of 0.5 mm would accordingly exhibit a dielectric strength of 20 kV. According to various standards and guidelines, elevated security margins may result in a reduced dielectric strength or voltage class for a predetermined minimum isolation thickness.

With these measures of providing a minimum thickness Di and a minimum distance D0, the printed circuit board with layer structure configuration can be employed for high voltage applications. In this manner, voltage differences in the kV range may be handled between connection lines 91 and 92. The printed circuit board of the invention may be used in measurement devices for measuring high voltages. For example, a high voltage to be measured may be converted into a measurement signal which can be evaluated with comparatively low voltages and currents. The printed circuit board may as well be integrated in devices which are per se designed for low voltages but might be exposed to high voltages in case of failure.

Figure 3:
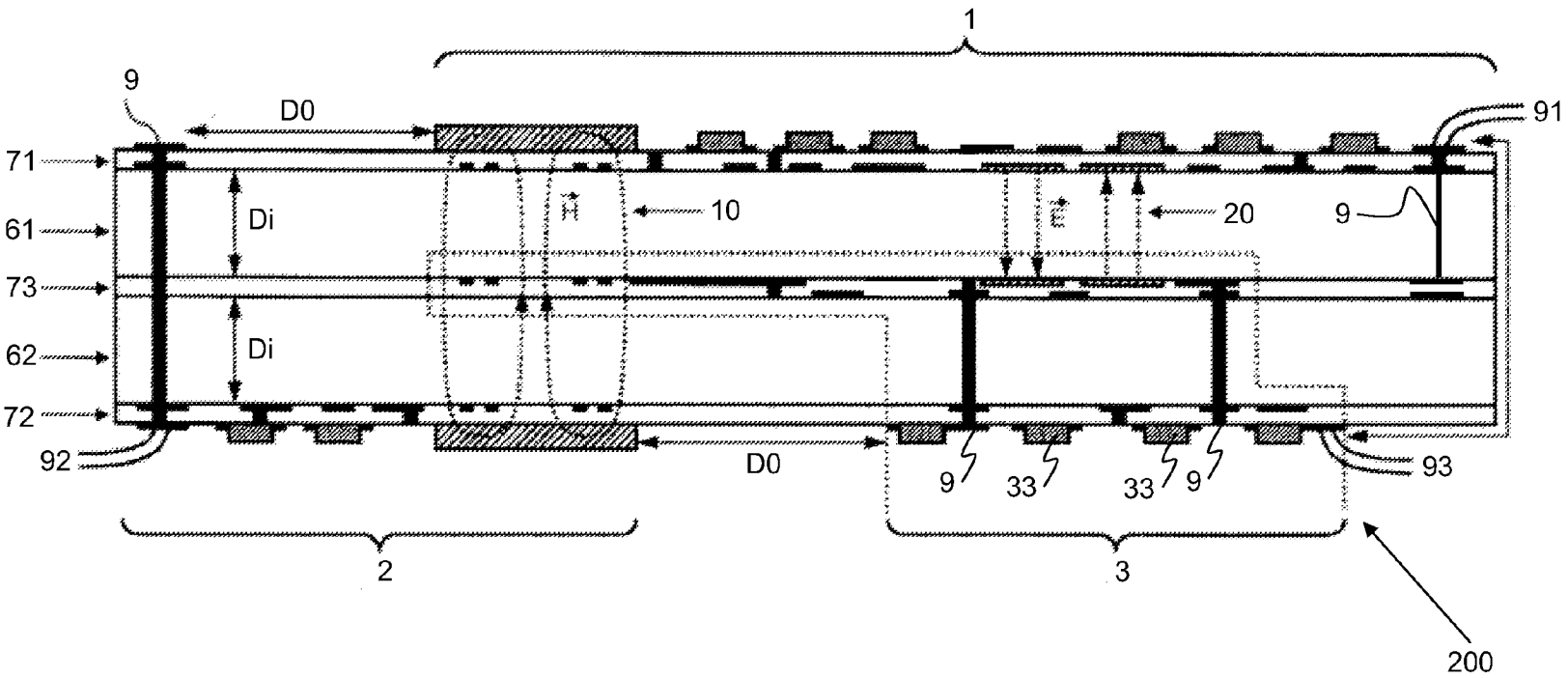
FIG. 3 is another longitudinal sectional view through a printed circuit board in a schematic illustration.

FIG. 3 shows a printed circuit board configuration 200 comprising three electric circuits 1, 2, 3. Two insulating barrier layers 61 and 62 and three insulating spacer layers 71, 72, 73 and three groups of connection lines 91, 92, 93 are employed. Electric circuits 1 of FIGS. 2 and 3 have an identical configuration. Electric circuit 2 is associated with portions of insulating barrier layer 62 and insulating spacer layer 72. Electric circuit 3 extends over portions of insulating spacer layer 72, insulating barrier layer 62, and insulating spacer layer 73. However, inductive transformer 10 couples all three electric circuits with each other and capacitive transformer 20 only couples electric circuit 1 with electric circuit 3. The required isolation distance is observed between all electric circuits, namely by the minimum distance D0 of clearance and creepage distances between the electric circuits on the one hand, and on the other by the minimum thickness Di of the insulating layers between the electric circuits. As a result, planar isolation regions are defined between the overlapping and transfer regions of transformers 10, 20, which extend along the surface of the printed circuit board, so that clearance and creepage distances of a sufficient length are created between conductive components of adjacent electric circuits, which observe or exceed the minimum distances D0. The planar isolation regions may extend over the edge of the printed circuit board, as indicated at the right edge of printed circuit board 200 in FIG. 3.

Figure 4:
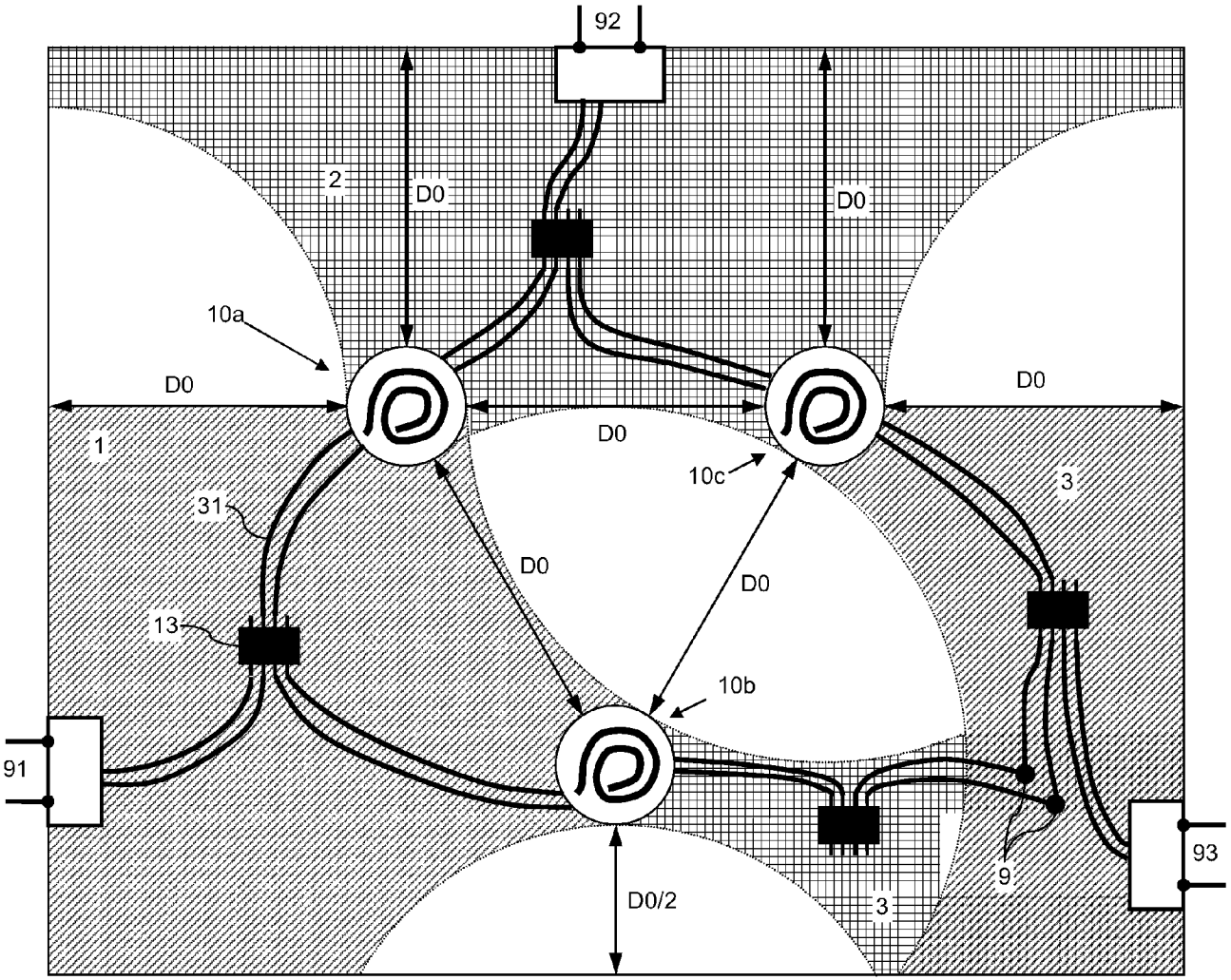
FIG. 4 is a plan view of portions of a layer of another printed circuit board.

FIG. 4 shows a printed circuit board having a layer structure as shown in FIG. 2, but for three electric circuits 1, 2, and 3. The upper surface of the layer structure is illustrated by diagonal hatching, while the lower surface is visualized by cross-hatching. Three inductive transformers 10 are used for coupling purposes between the electric circuits, namely 10*a* for coupling electric circuits 1 and 2, 10*b* for coupling electric circuits 1 and 3, and 10*c* for coupling electric circuits 2 and 3. With respect to the minimum thickness Di, the galvanic isolation distance is defined by insulating barrier layer 61 in each case. The minimum distance D0 as the clearance and creepage distance between the electric circuits is observed everywhere, even for transformer 10*b*, since the creepage distance extends over the edge of the printed circuit board, similar as illustrated on the right edge of the view in FIG. 3. For example, transformer 10*a* between the first and second electric circuits is surrounded by an associated planar isolation region with a distance D0+X to the connection lines 92 of the second electric circuit, transformer 10*b* between the third and first electric circuits is surrounded by an associated planar isolation region around the edge of the printed circuit board with a distance 2 D0/2+Y to the connection lines 91 of the first electric circuit, and transformer 10*c* between the second and third electric circuits is surrounded by an associated planar isolation region with a distance D0+Z to the connection line 92 of the second electric circuit. X, Y and Z indicate additional lengths in addition to the minimal clearance and creepage distance D0.

For designing printed circuit boards with four or even more electric circuits that are to be separated from each other, the surfaces of the printed circuit board are divided even more intelligently and/or a plurality of insulating barrier layers are employed. As in the case of FIG. 4, the components and the conductive traces for some electric circuits are mounted both on the upper surface and the lower surface of the layer structure. In order to be compliant with the required clearance and creepage distances according to the minimum distance D0, certain requirements must be met. Within a range of a distance D0 around transformers 10 there are no through holes or vias provided in the insulating layers. Components of adjacent electric circuits also observe this distance D0 to the transformer. The circular regions in FIG. 4 illustrate these conditions. Electric circuit 3 is distributed on two sides of the printed circuit board, which are connected to each other through vias 9 which are located outside the planar isolation regions around transformers 10*b* and 10*c*. Thus, the described method even permits to provide a minimum of vias for a plurality of electric circuits to be galvanically isolated and to employ only one or a few insulating barrier layers in the layer structure.

The configuration of the described printed circuit board may be modified. For example it is possible to provide two or more insulating spacer layers one above the other, within which the components of the electric circuits are accommodated. In this case, electrical/electronic components may be mounted by surface-mount technology (SMT) and may optionally be enclosed. However, the insulating barrier layer(s) remain responsible for the high dielectric strength of the printed circuit board.

In case of three or more electric circuits to be separated, the values of Di and D0 may as well be selected to be individually different, depending on the requirements for the dielectric strength of the individual electric circuits. In case of three electric circuits to be separated, for example, three different values may be used for D0, namely D012 for separating electric circuits 1 and 2, D013 for separating electric circuits 1 and 3, and D023 for separating electric circuits 2 and 3. The same applies to Di accordingly.

The invention claimed is:

1. A printed circuit board having a layer structure with a galvanic isolation between individual electric circuits, comprising:

a first coupling element associated with a first electric circuit;

a first insulating spacer layer for spatially separating components of the first electric circuit;

a second coupling element associated with a second electric circuit;

a second insulating spacer layer for spatially separating components of the second electric circuit; and a first insulating barrier layer having a minimum thickness (Di) for achieving a high dielectric strength between the electric circuits;

wherein adjacent to a third insulating spacer layer a second insulating barrier layer is provided which has, on a free side thereof, the second insulating spacer layer and components such as electrical/electronic components and conductive traces of a third electric circuit;

wherein, in an overlapping and transfer region, the first and second coupling elements overlap each other with the first insulating barrier layer sandwiched therebetween to form a transformer;

wherein with respect to the first coupling element or an associated ferrite plate, each transformer is surrounded by a first planar isolation region which extends along the surface of the printed circuit board to conductive components of the second circuit with a clearance and creepage distance of D0+X or D0+Y or D0+Z, and wherein with respect to the second coupling element or an associated ferrite plate, each transformer is surrounded by a second planar isolation region which extends along the surface of the printed circuit board to conductive components of the first circuit with a clearance and creepage distance of D0+X or D0+Y or D0+Z, wherein D0 is a minimum distance and X, Y, Z are additional lengths; and wherein electrical vias, if provided for power and signal supply of the first or second electric circuit and if embedded in the insulating barrier layer keep the minimum distance (D0) to conductive components of the respective adjacent electric circuit.

2. The printed circuit board as claimed in claim 1, wherein the first insulating barrier layer has conductive traces provided on both sides thereof and adjacent to the first and second insulating spacer layers.

3. The printed circuit board as claimed in claim 1, wherein the dielectric strength of the first insulating barrier layer is designed for at least 1000 volts.

4. The printed circuit board as claimed in claim 1, wherein the dielectric strength of the first insulating barrier layer is designed for at least 10,000 volts.

5. The printed circuit board as claimed in claim 1, wherein the first insulating barrier layer has a minimum thickness (Di) of 0.2 mm.

6. The printed circuit board as claimed in claim 1, wherein the first insulating barrier layer has a minimum thickness (Di) of 0.5 mm.

7. The printed circuit board as claimed in claim 1, wherein the first insulating barrier layer has a minimum thickness (Di) of 1 mm.

8. The printed circuit board as claimed in claim 1, wherein the first and/or the second electric circuit has two sections coupled with each other via a transformer.

9. The printed circuit board as claimed in claim 1, wherein the third electric circuit is separated from conductive components of the first and second electric circuits by planar isolation regions (D0+X, D0+Y, D0+Z) which are equal to or greater than the minimum distance (D0).

10. The printed circuit board as claimed in claim 1, wherein the second insulating spacer layer supports parts of the second electric circuit and of the third electric circuit.

11. The printed circuit board as claimed in claim 1, wherein a plurality of electric circuits are distributed on the upper and lower surfaces of the printed circuit board, and wherein each electric circuit keeps the minimum distance (D0) due to the planar isolation region and in case of overlapping provides the minimum dielectric strength due to the insulating barrier layer.

12. The printed circuit board as claimed in claim 2, wherein the dielectric strength of the first insulating barrier layer is designed for at least 1000 volts.

13. The printed circuit board as claimed in claim 2, wherein the dielectric strength of the first insulating barrier layer is designed for at least 10,000 volts.

14. The printed circuit board as claimed in claim 9, wherein the second insulating spacer layer supports parts of the second electric circuit and of the third electric circuit.

15. The printed circuit board as claimed in claim 2, wherein adjacent to a third insulating spacer layer a second insulating barrier layer is provided which has, on the free side thereof, the second insulating spacer layer and components such as electrical/electronic components and conductive traces of a third electric circuit.

16. The printed circuit board as claimed in claim 2, wherein a plurality of electric circuits are distributed on the upper and lower surfaces of the printed circuit board, and wherein each electric circuit keeps the minimum distance (D0) due to the planar isolation region and in case of overlapping provides the minimum dielectric strength due to the insulating barrier layer.

17. The printed circuit board as claimed in claim 3, wherein a plurality of electric circuits are distributed on the upper and lower surfaces of the printed circuit board, and wherein each electric circuit keeps the minimum distance (D0) due to the planar isolation region and in case of overlapping provides the minimum dielectric strength due to the insulating barrier layer.

18. The printed circuit board as claimed in claim 4, wherein a plurality of electric circuits are distributed on the upper and lower surfaces of the printed circuit board, and wherein each electric circuit keeps the minimum distance (D0) due to the planar isolation region and in case of overlapping provides the minimum dielectric strength due to the insulating barrier layer.

19. The printed circuit board as claimed in claim 1, wherein a plurality of electric circuits are distributed on the upper and lower surfaces of the printed circuit board, and wherein each electric circuit keeps the minimum distance (D0) due to the planar isolation region and in case of overlapping provides the minimum dielectric strength due to the insulating barrier layer.

* * * * *